United States Patent [19]

Dankman et al.

[11] 4,219,962

[45] Sep. 2, 1980

[54] TOY VEHICLE

[75] Inventors: Scott Dankman; Richard C. Levy; Bryan L. McCoy, all of Silver Spring, Md.

[73] Assignee: Scienco, Inc., Silver Spring, Md.

[21] Appl. No.: 937,132

[22] Filed: Aug. 28, 1978

[51] Int. Cl.[2] ..... A63H 33/26

[52] U.S. Cl. ..... 46/232; 46/177; 46/202

[58] Field of Search ..... 46/232, 177, 202

[56] References Cited

U.S. PATENT DOCUMENTS

| | | | |
|---|---|---|---|
| 3,080,678 | 3/1963 | Girz | 46/232 |
| 3,160,983 | 12/1964 | Smith et al. | 46/232 |
| 3,160,984 | 12/1964 | Ryan | 46/232 |
| 3,190,034 | 6/1965 | Ryan | 46/232 |
| 3,391,489 | 7/1968 | Lohr et al. | 46/232 |
| 3,411,236 | 11/1968 | Fileger et al. | 46/232 |
| 3,425,156 | 2/1969 | Field | 46/232 |
| 3,466,797 | 9/1969 | Hellsund | 46/232 |
| 3,664,060 | 5/1972 | Longnecker | 46/232 |
| 3,735,529 | 5/1973 | Roslen | 46/232 |

*Primary Examiner*—Houston S. Bell, Jr.

*Attorney, Agent, or Firm*—Cushman, Darby & Cushman

[57] ABSTRACT

A toy vehicle including provisions for generating realistic simulations of an engine operating through a range of gears, squealing tires, and a crash. Provisions are also described for providing a siren simulation. Preferred circuitry for generating such simulation signals is described.

36 Claims, 6 Drawing Figures

TOY VEHICLE

FIELD OF THE INVENTION

The present invention relates to toy vehicles, and in particular, to a toy car including provisions for realistically simulating the sounds associated with a vehicle.

BACKGROUND OF THE INVENTION

Toy vehicles which generate sound effects are well known. For example, toy vehicles including mechanical sound generators driven by the vehicle motor are described in U.S. Pat. No. 3,190,034 (Ryan, 1965), U.S. Pat. No. 3,391,489 (Lohr et al, 1968) and U.S. Pat. No. 3,441,236 (Fileger et al, 1968). Similarly, model train engines often include means for simulating the sound of the locomotive. Examples of toy locomotives are described in U.S. Pat. No. 3,664,060 (Longnecker, 1972) and U.S. Pat. No. 3,466,797 (Hellsund, 1969). Another toy vehicle providing sound effects is described in U.S. Pat. No. 3,080,678 (Girz, 1963). Switching devices cooperate with the toy drive mechanism, or with a steering mechanism to selectively apply various voltages to diaphragm-type signalling devices for the purpose of producing a musical cord or other combinations of simultaneously sounding tones. Other toys, such as that described in U.S. Pat. No. 3,160,983 (Smith et al, 1964) include provisions for generating sound effects only during such time periods as the toy is turning.

In general, toy vehicles including electrical apparatus for generating an audible simulation of an engine sound of a frequency in accordance with vehicle speed are also well known. For example, in various of the locomotive toys, the locomotive sound is generated by periodically enabling an oscillator with a cam switch coupled to the locomotive wheel. Another example is described in U.S. Pat. No. 3,425,156 (Field, 1969). The Field patent describes a toy vehicle which runs on tracks (a slot car) including a relaxation oscillator which is driven by the voltage on the track through an optical link. The sound level and frequency of the engine simulation is thus varied in accordance with the magnitude of the track voltage.

Apparatus for simulating engine sounds adapted for mounting on toy riding vehicles such as bicycles or the like, are also generally known. Examples of such systems are described in U.S. Pat. No. 3,160,984 (Ryan, 1964) and U.S. Pat. No. 3,735,529 (Roslen, 1973).

SUMMARY OF THE INVENTION

The present invention provides apparatus for realistically simulating the sound of an engine. A signal indicative of the speed of the vehicle is generated and applied to an RC timing network. The output signal of the timing network drives an oscillator circuit, the output of which is used to derive the engine noise simulation. Means are provided to sense acceleration and deceleration of the vehicle and to change the time constant of the RC network. The RC network charges in accordance with a first time constant during periods of acceleration and discharges in accordance with a second time constant during periods of deceleration of the vehicle. The discharging is preferably more rapid than charging. The effect of such change in charging and discharging time constants is to provide a realistic simulation of engine sounds.

Further, in accordance with another aspect of the invention, a still more realistic sound can be provided by deriving a plurality of tones from the oscillator output signal and generating different combinations of tones during periods of acceleration and deceleration.

In addition, in accordance with another aspect of the present invention, a toy vehicle may be provided which simulates not only engine sound but the screeching of tires, the sounds of a crash, and a siren.

BRIEF DESCRIPTION OF THE DRAWING

A preferred exemplary embodiment of the present invention will hereinafter be described in conjunction with the appended drawing wherein like numerals denote like elements and:

Referring now to FIGS. 1 and 1*a*, there is shown a toy vehicle 10 in accordance with the present invention. Toy vehicle 10 includes a body 12 with wheels 14. Toy 10 is suitably of a size that allows for pushing by hand, although it should be appreciated that the present invention can readily be adapted to larger riding toys such as bicycles, or the like.

Suitable means 16 for generating a signal indicative of the speed of the vehicle are disposed within body 12 speed signal generator 16 may be maintained body 12 in any conventional manner. The speed signal generator 16 is suitably a conventional DC motor having the shaft thereof mechanically coupled to the axel of wheels 14. The mechanical coupling can be effected in any conventional manner, such as, for example, suitable gearing, well known in the art, and generally indicated as 15. Similarly, the axels of wheels 14 may be coupled to body 12 in any of the conventional methods well known in the art. Speed signal generator 16 will be more fully described in conjunction with FIG. 2.

Figures 1, 1A:
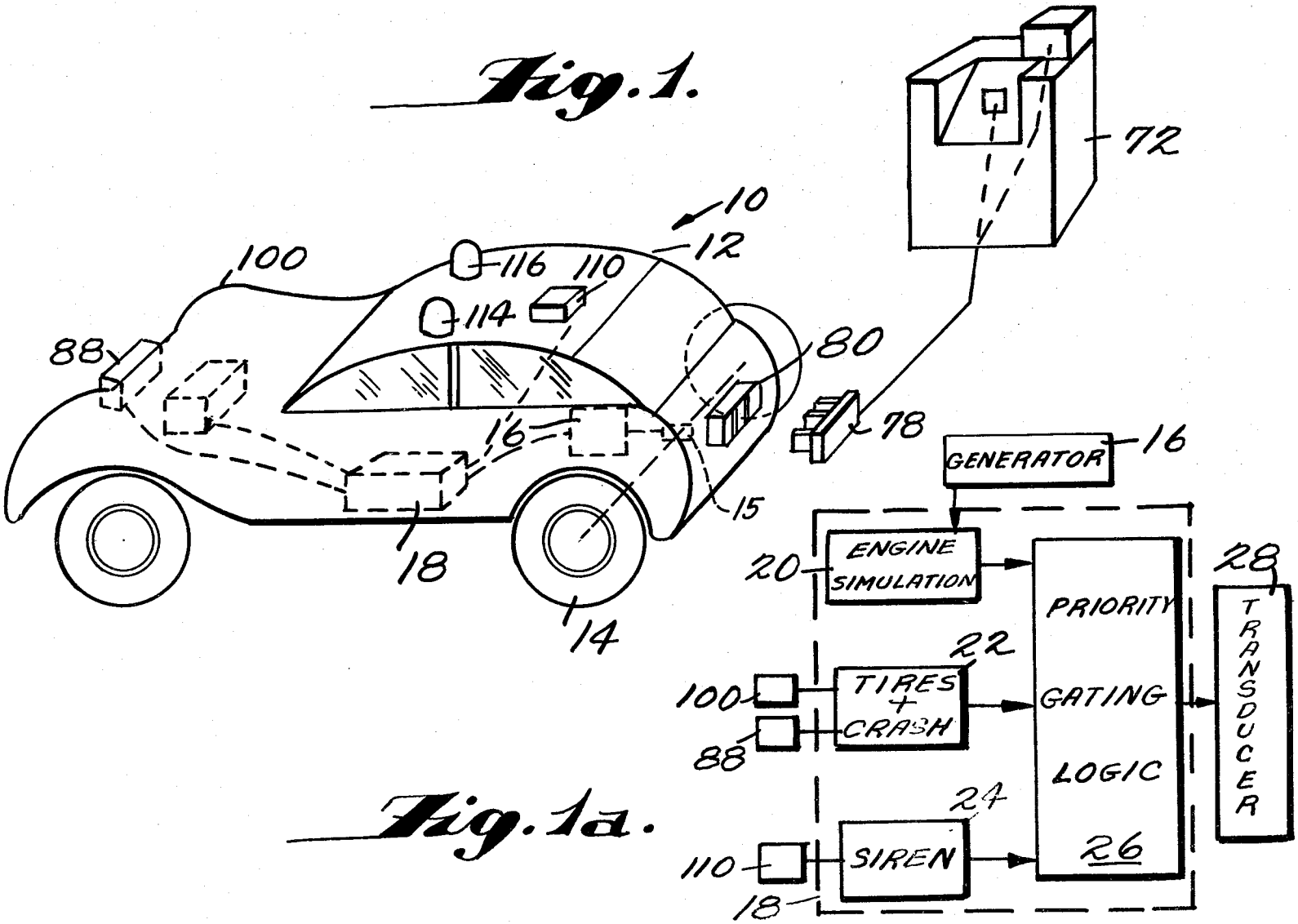
FIG. 1 is a pictorial schematic of a toy vehicle in accordance with the present invention.
FIG. 1*a* is a block diagram of the electronic circuitry 18 of FIG. 1.

The speed signal from generator 16 is applied to an electronic circuit 18, suitably formed as a single integrated chip. As illustrated in FIG. 1*a*, electronic circuit 18 suitably includes respective portions for generating respective signals for simulating engine noise (20), the sound of squealing tires and the sounds of a crash (22) and the sounds of a siren (24). The respective simulation signals are suitably applied to priority gating logic 26, also suitably included in the single integrated circuit. The output signals of priority gating logic 26 are applied to a suitable transducer 28 such as a speaker. Engine simulation circuitry 20, tire and crash simulation circuitry 22 and siren simulation circuitry 24 will hereinafter be described in more detail in conjunction with FIGS. 2, 3 and 4, respectively. Priority gating logic 26 and transducer 28 are shown in more detail in FIG. 5.

Figure 2:
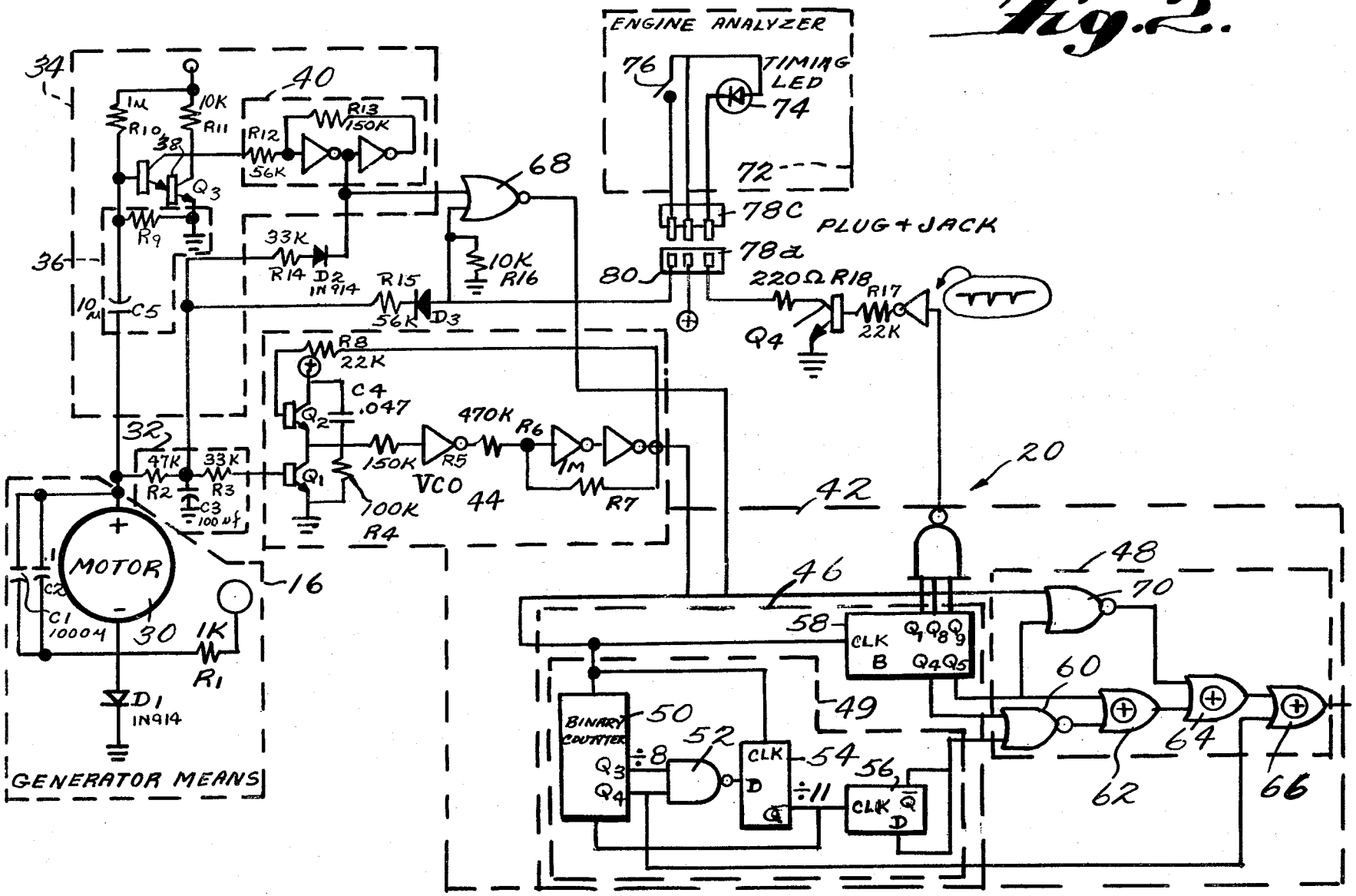
FIG. 2 is a schematic diagram of the electronic circuit for generating the engine simulation signals.

Referring now to FIG. 2, speed signal generator 16 suitably comprises a conventional DC motor 30 such as those generally used in battery operated toys. The shaft of motor 30 is mechanically coupled to the wheels 14 of vehicle 10 in any conventional manner such that the motor armature is rotated in accordance with rotation of wheel 14. Motor 30 therefore operates as a generator, generating a signal of a magnitude generally in accordance with the speed of the vehicle 10.

The negative output terminal of motor 30 is suitably positively biased with respect to ground potential to facilitate cooperation with the transistor circuits of engine noise simulator circuit 20. A resistor R1 and diode D1 are serially connected between positive potential and ground potential. The negative terminal of motor 30 is connected to the juncture between resistor R1 and diode D1. Motor 30 is thus biased 0.7 volts (the junction potential of diode D1). A capacitance (C1, C2) is coupled across the motor output terminals to smooth the speed signal by choking off RF signals in ripple.

The speed signal from generator 16 is applied to an RC timing circuit 32. Timing circuit 32 is suitably a simple RC network comprising resistors R2 (47 KΩ) and R3 (33 KΩ) and capacitor C3 (100 μf). Resistors R2 and R3 are serially connected between the input and output terminals of timing circuit 32. Capacitor C3 is connected from the juncture between resistors R2 and R3 to ground potential.

The speed signal is also applied to a circuit 34 for sensing respective states of acceleration and deceleration of vehicle 10. The speed signal is applied to a conventional differentiator circuit 36. Differentiator circuit 36 is suitably formed of a capacitor C5 (10 μf) and resistor R9 (200 KΩ). The speed signal is, in effect, applied across the serial combination of capacitor C5 and R9 and the differentiated output signal taken across resistor R9. The differentiated signal is applied to a conventional Darlington amplifier 38. Amplifier 38 is biased by resistors R10 (1 MΩ) and R11 (10 KΩ). Positive output signals from differentiator 36 (indicative of increasing speed) cause the Darlington amplifier 38 to saturate (low level output). Similarly, negative output signals from differentiator 36 (indicative of decreasing speed) cause Darlington amplifier 38 to cut off (high level output). The output signal of Darlington amplifier 38 is applied to a conventional Schmitt trigger circuit 40. The output signal of Schmitt trigger circuit 40 is indicative of the respective acceleration or deceleration state of vehicle 10.

The effective time constant of timing circuit 32 is selectively changed during deceleration periods of vehicle 10. A unidirectional conductive device (diode) D2 and resistor R14 (33 KΩ) is connected between Schmitt trigger circuit 40 and the juncture between resistors R2 and R3 and capacitor C3 in timing circuit 32. When the speed signal from motor 30 decreases, differentiator 36 generates a negative voltage to cut off Darlington amplifier 38. The resultant high level output signal for Darlington amplifier 38 causes Schmitt trigger circuit 40 to generate a low level output signal. The low level output signal by Schmitt trigger 40, in effect, renders diode D2 conductive. Resistor R14 is therefore functionally connected into timing circuit 32. Thus, during deceleration periods, the time constant of circuit 32 is determined by capacitor C3 and resistors R2, R3 and R4. However, during acceleraion periods, Schmitt trigger circuit 40 generates a high level signal and resistor R14 is effectively isolated from RC network 32. Thus, RC network 32 discharges at a faster rate (in response to decreasing speed signals) than it charges (in response to increasing speed signals).

Figure 5:
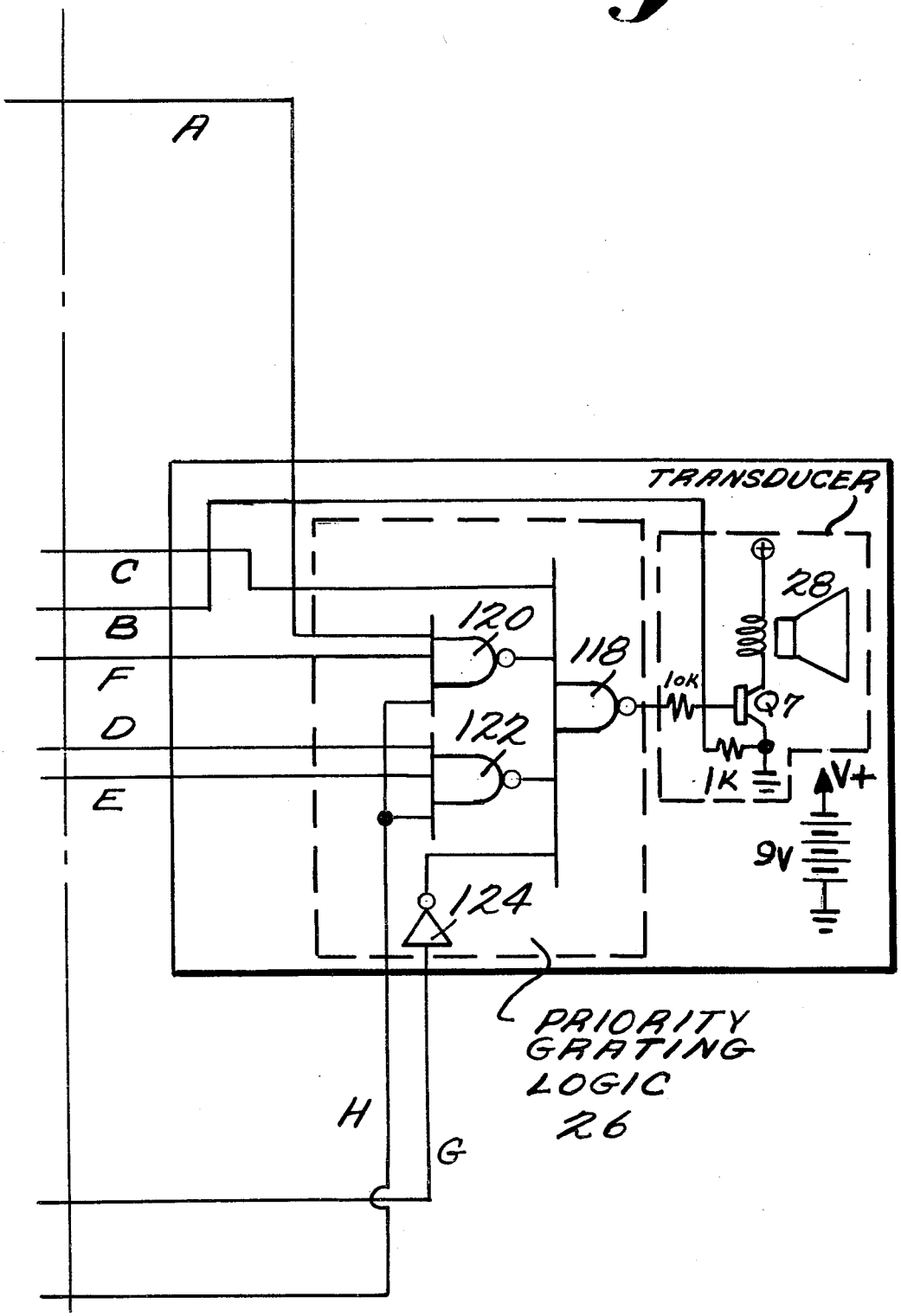
FIG. 5 is a schematic diagram of priority gating logic and a transducer for use with the circuits of FIGS. 2, 3 and 4.

The output terminal of timing circuit 32 is coupled to a tone signal generator 42. Tone signal generator 42 generates an engine noise simulation signal having a frequency content in accordance with the output signal of timing circuit 32. The engine noise simulation signal is generated at terminal A, and is applied to priority gating logic 26 (FIG. 5).

Tone signal generator 42 suitably comprises a conventional voltage controlled oscillator (VCO) 44, a frequency divider network 46, and a combinatorial logic 48. VCO 44 is responsive to the output signal of timing circuit 32 and thus generates an output signal having a frequency representative of the charge on capacitor C3. The VCO output signal is applied to divider network 46, which generates a plurality of tone signals having frequencies in respective predetermined relationship with the VCO output signal. In the preferred embodiment, divider network 46 includes a divide by eleven circuit 49 and a counter 58.

Divide by eleven circuit 49 is formed of a conventional binary counter 50, a conventional NAND gate 52, and two conventional D-type flip-flops 54 and 56. Output signals from the third state Q3 (÷eight) and fourth stage (÷16) of counter 50 are applied to the input terminals of NAND gate 52. The output of NAND gate 52 is applied to D input terminal of D-type flip-flop 54. D-type flip-flop 54 is clocked by the VCO output signal. The $\overline{Q}$ output of D flip-flop 54 is applied to the reset terminal of counter 50 and to the clock terminal of D flip-flop 56. The $\overline{Q}$ output of flip-flop 56 is tied back to the D input thereof, and provides an output signal having a frequency equal to the VCO output frequency divided by eleven.

Counters 50 and 58 are suitably National Semiconductor CD4040 12 stage ripple carry binary counter/dividers. D-type flip-flops 54 and 54 are suitably National Semiconductor MM74C74 dual D flip-flops. Binary counter 58 provides respective tone signals having frequencies equal to VCO output frequency divided by respective multiples of two.

The various tone signals are selectively combined by combinatorial logic 48 to provide an engine noise simulation signal of desired tonal quality. The output signals from divide by eleven frequency divider 49 and the Q4 output of counter 58 are applied to the respective input terminals of a two input NOR gate 60. The output of NOR gate 60 and the Q5 (÷32) output terminal of counter 58 are connected to the respective input terminals of a conventional two input exclusive OR gate 62. The output of exclusive OR gate 62 is applied to one input terminal of an exclusive OR gate 64. The other input terminal of exclusive OR gate 64 is receptive of a signal indicative of the acceleration/deceleration state of vehicle 10, derived from the output signal of sensor circuit 34, as will be explained. The output terminal of exclusive OR gate 64 is applied to one input of another exclusive OR gate 66. The other input terminal of exclusive OR gate 66 is connected to the Q4 output of counter 50 in divide by eleven circuit 49. Exclusive OR gate 66 provides the engine noise simulation signal (terminal A).

To provide a more realistic engine sound simulation, it is desirable that the engine sound have different tonal qualities during acceleration and deceleration states. To this end, the output signal of Schmitt trigger 40 of sensing circuit 34 is applied (through a NOR gate 68, as will be explained) to one input terminal of a NOR gate 70 in combinatorial logic 48. The other input terminal of NOR gate 70 is connected to the Q5 (÷32) output of binary counter 58. NOR gate 70 is enabled or inhibited in accordance with the acceleration/deceleration state of vehicle 10 by the signal from sensor 34. The signal to the second input terminal of NOR gate 68 is generally zero (as will be explained). Accordingly, low level output signal generated by Schmitt trigger 40 during deceleration periods cause a high level signal to be applied to one terminal of NOR gate 70, thus inhibiting the gate. Thus, during periods of deceleration, the combination of tones passed by exclusive OR gate 64 is essentially the signals passed by exclusive OR gate 62. However, during periods of acceleration, a high level signal is generated by Schmitt trigger 40. Accordingly, NOR gate 68 is inhibited and a low level signal is applied to the input terminal of NOR gate 70. The output state of NOR gate 70 is therefor controlled by the signals from the Q5 output of counter 48. Thus, during periods of deceleration an extra tonal component is interjected into the engine simulation sound through exclusive OR gate 64. The extra tonal component in the preferred embodiment, in effect, cancels the tone signal from the Q5 (÷32) output applied through exclusive OR gate 62.

In accordance with another aspect of the present invention, remote engine analyzer accessory 72 may be provided. Engine analyzer accessory 72 is formed of passive components and is adapted for electrical connection into engine noise simulator circuit 20. Engine analyzer accessory 74 includes a LED 74, and a momentary contact switch 76. LED 74 is connected between first (78*a*) and second (78*b*) terminals of a conventional three terminal plug 78. The third terminal (78c) of plug 78 is connected to the second terminal (78b) through switch 76. Engine analyzer accessory 72 is selectively interconnected into circuit 20 through a conventional socket or jack 80 corresponding to plug 78.

When connected into circuit 20, switch 76 controls a simulation of an engine "revving" in neutral gear. Closure of switch 76 causes timing circuit 32 to charge in accordance with a third predetermined time constant, and enables NOR gate 70 in combinatorial logic 48 to provide the combination of tones associated with acceleration. The jack of socket 80 corresponding to plug terminal 78*b* is connected to the positive voltage source. The jack of socket 80 corresponding to terminal 78*c* is connected to the second input terminal of NOR gate 68 and, through a diode D3 and resistor R15 (56KΩ) to the juncture of capacitor C3 and resistors R2 and R3 in timing network 32. Switch 76 therefore selectively applies a positive potential to the cathode of diode D3. Diode D3 is thus rendered conductive functionally connecting resistor R15 into timing circuit 32. Accordingly, capacitor C3 charges in accordance with a third time constant determined by the respective values of R2, R3, R15 and C3.

It should be noted that vehicle 10 is typically motionless when the engine analyzer accessory 72 is plugged in. However, the charging of capacitor C3 through diode D3 and resistor R15 is sensed as acceleration by differentiator 36. Accordingly, Darlington amplifier 38 saturates and Schmitt trigger 40 produces a high level output signal. Thus, resistor R14 is isolated from timing circuit 32. When switch 76 is thereafter opened, the voltage source is effectively disconnected from timing circuit 32. Accordingly, capacitor C3 begins to discharge. Sensing circuit 34 senses the discharge and effectively connects resistor R14 into the timing circuit. Capacitor C3 therefor discharges in accordance with the "deceleration" time constant.

Switch 76 is suitably of the push-button variety of momentary contact switch. Thus, when momentarily depressed then released, the "revving" of an engine while in neutral gear is simulated. As noted above, switch 76 when closed, also applies a positive voltage to one input terminal of NOR gate 68, thus enabling NOR gate 70 is combinatorial logic 48 to provide the acceleration tone combination. NOR gate 60 effects the acceleration-to-deceleration tone combination essentially instantaneously upon opening of switch 76. Thus, any deleterious effects due to the finite response time sensor 34 are avoided.

Engine analyzer accessory 72 also includes an LED 74 connected between plug terminals 78*a* and 78*b*. LED 74 flashes at a rate in accordance with the engine speed. The jack of socket 80 corresponding to terminal 78*a* is connected through a resistor (220Ω) to the collector of a transistor Q4. The emitter of transistor Q4 is connected to ground. The base of transistor Q4 is receptive of signals derived from the tone signals produced by counter 58 of divider network 46. Transistor Q4 is periodically rendered conductive by the tone signals at a rate in accordance with the VCO frequency. Thus, when engine analyzer accessory 72 is plugged into vehicle 10, LED 74 is periodically energized at a rate in accordance with the engine simulation signal. LED 74 thus represents a timing light.

As noted above, the engine simulation signals (provided at output terminal A) are applied to priority gating logic 26 and therefrom to transducer 28 as will hereinafter be described in conjunction with FIG. 5. It should be appreciated, however, that the engine noise simulation signals can be directly applied to transducer 28.

Where vehicle 10 is of the handheld type and is pushed along the ground by a child, the typical intermittent pushing motions by the child causes the simulation of the changing of gears. For example, where the car is pushed to arms length and the child temporarily slows the forward motion of vehicle 10 as he moves his own body forward, the sound of changing gears is simulated.

Figure 3:
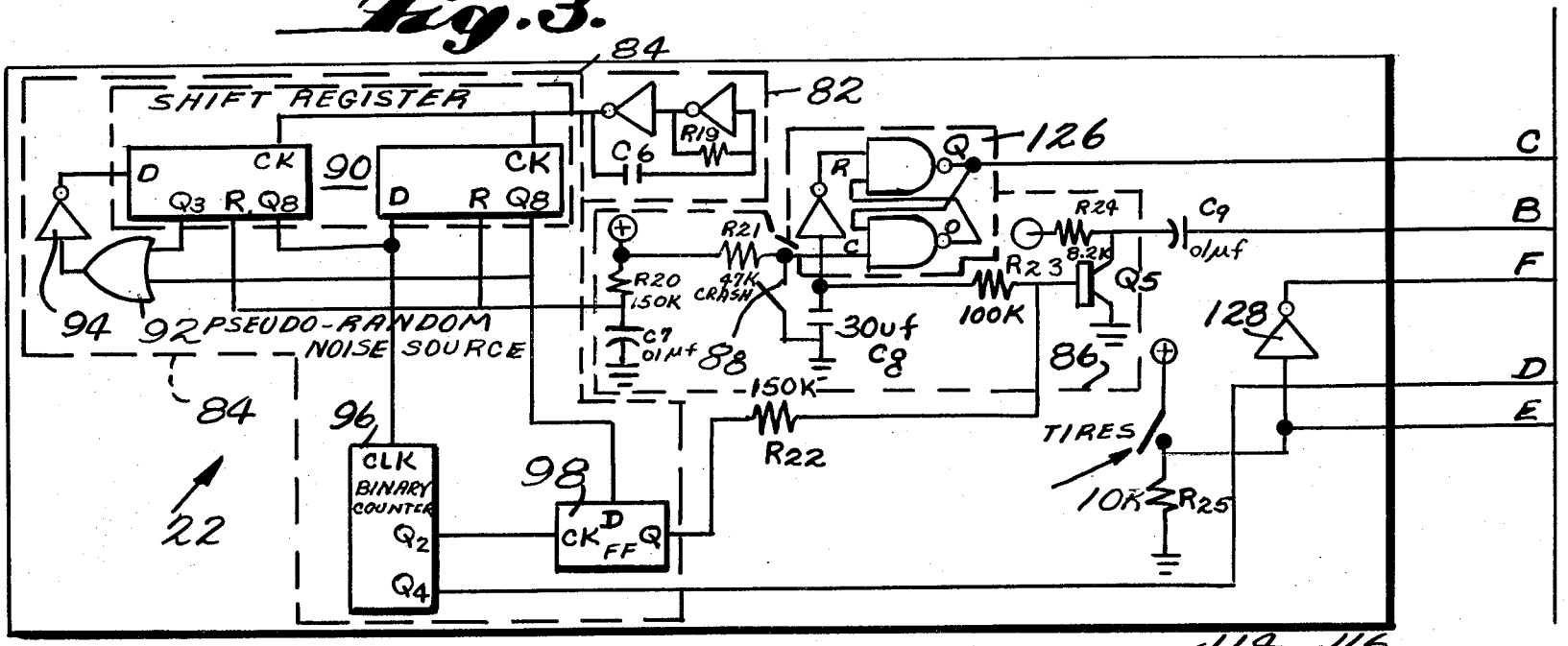
FIG. 3 is a schematic of an electronic circuit for generating signals for simulation of the noises of a crash and the noises of squealing tires.

In accordance with another aspect of the present invention, a simulated crash sound and the sound of squealing tires are also selectively provided. Crash and squealing tires simulation circuit 22 is shown in FIG. 3. The crash noise simulation signal is provided by an oscillator 82, a random noise signal generator 84 and a timing circuit 86.

Pseudo-random signal generator 84 suitably comprises a shift register 90, and a two input exclusive OR gate 92 and inverter 94, a binary counter 96 and a D-type flip-flop 98. Shift register 90 is suitably formed of two National Semiconductor MM74C164 eight bit parallel out, serial shift registers connected in series. Shift register 90 is clocked by the signals from oscillator 82. The input terminals of exclusive OR gate 92 are coupled to respective output terminals of shift register 90. In the preferred embodiment, exclusive OR gate 92 receives signals from the third and last stages of shift register 90. The output of exclusive OR gate 92 is inverted by inverter 94 and applied to the data input terminal of shift register 90. Output signals from another of the stages of shift register 90 (the 8 stage) is applied as a clock signal to binary counter 96. Binary counter 96 is suitably a National semiconductor MM74C161 binary counter with asynchronous clear. The output signals from one stage (Q2) of counter 96 is applied as a clock signal to D-type flip-flop 98. The data input D of flip-flop 98 is connected to shift register 90 (suitably the last stage). The pseudo-random signal generated at the Q output of flip-flop 98 is applied to the base of a transistor amplifier Q5 through a resistor R22 (150KΩ).

Timing circuit 86 suitably comprises a crash switch 88 connected in series with a resistor R21 (47KΩ) between the voltage supply and ground potential. A capacitor C8 (30μf) is coupled across switch 88. Switch 88 is also connected through a resistor R23 (100KΩ) to the base of a transistor amplifier Q5. Transistor Q5 is biased by resistors $24 (8.2KΩ) such that transistor Q5 saturates when capacitor C8 is charged beyond a predetermined threshold value. When crash switch 88 is closed, capacitor C8 is discharged, causing transistor Q5 to be biased in its active region. Transistor Q5 thus provides the pseudo-random signal as the crash simulation signal at output terminal B.

Crash switch 88 is suitably a momentary contact switch disposed on body 12 of vehicle 10 to close when vehicle 10 comes into contact with an obstacle. When switch 88 reopens capacitor C8 gradually recharges, ultimately driving transistor Q5 into saturation. The bias providec by the charging of capacitor C8 causes the crash simulation signal to gradually decay in amplitude.

A tire screeching simulation signal is also generated by pseudo-random signal generator 84. The tire screeching signal is taken from one stage of (Q4) of binary counter 96. It has been found that by dividing the random noise signal by factors of two, more components of the oscillator signal driving the pseudo-random noise generator appear in the output signal. This provides a more tonal characteristic in the signal. The tire screeching signal is provided at terminal D of circuit 22, and is applied to the priority gating logic 26.

A switch 100 is utilized to provide control signals at terminals E and F of circuit 22 to provide for selective application of the tire screeching signal to transducer 28, as will be explained. Switch 100 is preferably a centrifugal force actuated switch, which is closed in response to turns made by vehicle 10 at speeds above a given threshold. For example, a mercury switch having respective conductors on the bottom and sides of the casing may be utilized, disposed along the transverse axis of vehicle 10. When vehicle 10 turns at a speed beyond a predetermined threshold, the centrifugal force will cause the mercury to effect a connection between the bottom conductor and the conductor disposed on the vertical side, thus closing the switch. Other types of switches, may of course be utilized.

Figure 4:
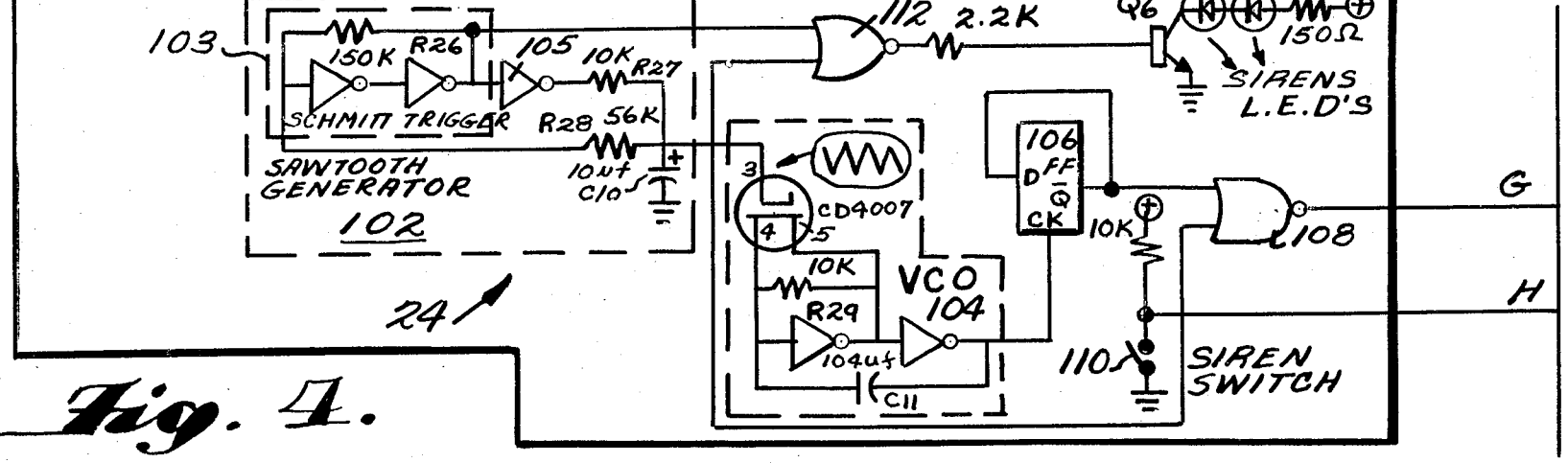
FIG. 4 is a schematic diagram of a suitable circuit for generating signals to simulate the sound of a siren.

As previously noted, a siren simulation may also be provided. Referring now to FIG. 4, siren simulation circuit 24 suitably comprises a sawtooth waveform generator 102 coupled to a voltage controlled oscillator (VCO) 104. The output of VCO 104 is utilized to clock a D-type flip-flop 106 having data input coupled to the $\overline{Q}$ output in a standard counter configuration. Flip-flop 106 operates to provide a squarewave signal from the output of VCO 104. The $\overline{Q}$ output of flip-flop 106 is applied to one input of a conventional two input NOR gate 108. The other input of NOR gate 108 is responsive to a siren switch 110. When switch 110 is open, a high level signal is applied to one input terminal of NOR gate 108, to effectively inhibit the gate. When switch 110 is closed, a low level signal is applied and gate 108 enabled. The siren simulation signals are thus selectively provided at the output of gate 108 (terminal G).

Sawtooth waveform generator 102 suitably comprises a Schmitt trigger circuit 103, coupled to a capacitor C10 (10μf) through a inverter 105 and resistor R27 (10KΩ). The input of Schmitt trigger circuit 103 is coupled to capacitor C10 through a resistor R28 (56KΩ). The output signal from Schmitt trigger 103 is applied to capacitor C10 to charge the capacitor until a certain threshold is reached. Schmitt trigger circuit 103 then changes stage and the capacitor is discharged. The charging and discharging constants are controlled by the respective values of resistors R27 and R28.

Switch 110 also provides a control signal to one input terminal of a two input NOR gate 112. The other input of NOR gate 112 is connected to the output of Schmitt trigger circuit 103 in sawtooth waveform generator 102. The output of NOR gate 112 is supplied to a driving transistor Q6 which controls the operation of siren LED's 114 and 116. LED's 114 and 116 are suitably disposed on body 12. NOR gate 112 is inhibited by the high level signal applied to one input when siren switch 110 is open. When siren switch 110 is closed, gate 112 is enabled. The output signal of Schmitt trigger circuit 103 is thus applied to transistor Q6 to periodically activate LED's 114 and 116. The control signal provided by switch 110 is also provided at terminal H, for application to priority gating logic 26.

Referring now to FIG. 5, priority gating logic 26 will be described. In the preferred embodiment, the respective simulation signals are applied to transducer 28 on a mutually exclusive predetermined priority basis. The crash signal takes precedence over all other simulations. The siren signal is accorded second priority and the tire screeching signal accorded third priority. The engine simulation signal is deemed subservient to all of the other signals.

To this end, priority gating logic 26 is formed of a conventional four input NAND gate 118, two-three input NAND gates 120 and 122, respectively, and an inverter 124. Transducer 28 is suitably a conventional speaker driven by a transistor amplifier Q7. The crash simulation signal, produced at terminal B of circuit 22 is applied directly to the drive transistor Q7 of transducer 28. Also applied to the drive transistor of transducer 28 are the output signals of four input NAND gate 118.

A control signal is produced at terminal C of circuit 22 by an RS flip-flop 126 (FIG. 3) responsive to the voltage produced by capacitor C8. The control signal is applied to one input of NAND gate 118. The other inputs of four input NAND gate 118 are the outputs of three input NAND gates 120 and 122 and inverter 124. During periods when the crash signal is generated at terminal B and applied to transducer 28, RS flip-flop 126 generates a low level signal at terminal C. The low level signal applied to NAND gate 118 forces the output signal of the NAND gate to remain at a high level. Thus, during periods when the crash signal is produced, the other simulation signals are effectively isolated from transducer 28.

The siren signal produced at terminal G of circuit 24 is applied through inverter 124 to NAND gate 118. The control signal from siren switch 110, produced at terminal H is appled to one terminal of each of the three input NAND gates 120 and 122. Thus, when siren switch 110 is closed, the low level signal at terminal H effectively inhibits NAND gates 120 and 122 (forcing the outputs thereof to be high) and isolating the engine sound simulation and squealing tire simulation signals from transducer 28.

The tire screeching simulation signal generated at terminal D is applied to one input of NAND gate 122. When tire switch 100 is closed, a high level signal is provided at terminal E of circuit 22. Terminal E is connected to a second input of NAND gate 122. Thus, assuming NAND gate 118 to be enabled and siren switch 110 to be open, NAND gate 122 selectively applies the tire squealing simulation signal to transducer 28 under the control of switch 100. A further control signal is generated from switch 100 by inverter 128 (FIG. 3) and produced at terminal F of circuit 22. This signal is applied to NAND gate 120 as a control signal.

The engine noise simulation signal produced at terminal A of circuit 20 is applied to one input terminal of NAND gate 120. NAND gate 120 is also receptive of the tire control signal at terminal F. When the signals at terminal H (siren) and terminal F (tires) are high, the engine noise simulation signal is applied to NAND gate 118. Assuming NAND gate 118 not to be inhibited by the crash control signal (terminal C), the engine noise simulation signal is applied to transducer 28. However, if either tire switch 100 or siren switch 110 is closed, the low level signal produced at terminals F or H effectively inhibits NAND gate 120 and isolates the engine noise simulation signals from transducer 28.

It should be appreciated, of course, that any priority scheme can be utilized.

It will be understood that the above description is of illustrative embodiments of the present invention and that the invention is not limited to the specific form shown. For example, while toy vehicle 10 is described as a handheld toy, the present invention can be easily adapted to riding vehicles such as bicycles or the like. Further, speed signal generator 16 may be mechanically coupled to a separate wheel or friction motor, rather than the primary wheels of vehicle 10. In addition, any combination of one or more of the simulation signals herein described can be utilized. Various modifications can be made in the design and arrangements of the elements as will be apparent to those skilled in the art without departing from the scope of the invention as expressed in the appended claims.

What is claimed is:

1. A toy vehicle comprising:

a body;

electronic means disposed on said body for selectively generating respective electrical simulation signals, said electronic means including:

first means, for selectively generating an engine noise simulation signal, second means, for selectively generating a crash simulation signal, and third means for selectively generating a tire screeching simulation signal;

said toy further comprising transducer means disposed in said body for generating an audible output indicative of electrical signals applied thereto; and means for selectively applying said simulation signals as input signals to said transducer means.

2. The toy of claim 1 wherein said first means comprises:

means responsive to a speed signal representative of vehicle speed, said signal having a frequency which increases with increasing vehicle speed in accordance with a first predetermined time constant and decreases with decreasing vehicle speed in accordance with a second predetermined time constant.

3. The toy of claim 1 wherein said second means comprises:

switch means for enabling said means for selectively applying to effect application of said crash simulation signal to said transducer means;

a pseudo-random noise signal generator for generating a pseudo-random noise signal;

an amplifier, responsive to said pseudo-random noise signal and a bias signal applied thereto for generating said crash simulation signal; and biasing means, responsive to said switch means, for generating a biasing signal of varying magnitude to said amplifier to effect a gradual amplitude decay of said crash simulation signal.

4. The toy of claim 1 wherein said electronic means includes:

governor means responsive to said speed signal for generating a frequency control signal indicative of said speed signal with a controlled rate of change.

5. The toy of claim 3 wherein said third means for generating said tire screeching simulation signal comprises:

a frequency divider, responsive to said pseudo-random noise signal; and switching means for selectively enabling said means for selectively applying said simulation signals, to effect application of said frequency divider output signal to said transducer means.

6. The toy of claim 1 wherein said means for selectively applying said simulation signals comprises logic means for applying said simulation signals to said transducer in accordance with a mutually exclusive predetermined priority.

7. The toy of claim 1 further including a remote engine analyzer accessory, adapted for removable electrical connection to said electronic means for varying the tonal quality of said engine simulation signal and controllably effecting generation thereof.

8. The toy of claim 2 further including a remote engine analyzer accessory adapted for electrical interconnection into said electronic means, for effectively altering said first means to generate said engine noise simulation signal with increasing frequency in accordance with a third predetermined time constant.

9. The toy of claims 7 or 8 wherein said remote analyzer accessory further includes an illumination device, and means for removably electrically connecting said illumination device to said first means whereby said illumination device flashes at a rate in accordance with said engine noise simulation signal frequency.

10. A toy for audibly simulating engine noise in a toy vehicle comprising:

means adapted for disposition on said toy vehicle for generating a speed signal representative of the speed of said vehicle;

electronic means, adapted for disposition on said vehicle and responsive to said speed signal, for generating an engine noise simulation signal having a frequency which increases with increasing speed in accordance with a first predetermined time constant and which decreases with decreasing speed in accordance with a second predetermined time constant;

transducer means, adapted for disposition on said vehicle for generating audible output signals representative of electrical input signals applied thereto; and means for applying said engine noise simulation signal as an input signal to said transducer means.

11. The toy of claim 10 wherein said electronic means comprises:

an RC network responsive to said speed signal and having one of said first or second predetermined time constants, for developing a frequency control signal;

oscillator means, responsive to said frequency control signal, generating an output signal having a frequency composition in accordance with said frequency control signal; and sensing means responsive to said speed signal, for effectively altering said RC network to change the time constant thereof to the other of said first or second predetermined time constants.

12. The toy of claim 11 wherein said oscillator means comprises:

means for generating a plurality of tone signals having respective frequencies in accordance with said frequency control signal; and combinatorial logic means responsive to said tone signals and signals from said sensing means, for selectively generating respective output signals comprising differing combinations of said tone signals, during periods of increasing speed and decreasing speed, respectively.

13. The toy of claim 11 further including:

remote engine analyzer means, adapted for removable electrical connection to said electronic means, for effectively alterning said RC network to change the time constant thereof to a third predetermined time constant and for charging said RC network in accordance with said third predetermined time constant.

14. The toy of claim 13 wherein said remote engine analyzer means further includes means for effecting a change in the tonal quality of said engine simulation signal.

15. The toy of claim 13 wherein said remote analyzer means further includes an illumination device, and means for removably electrically connecting said illumination device to said oscillator means whereby said illumination device flashes at a rate in accordance with said engine noise simulation signal frequency.

16. A toy vehicle comprising:

a body;

means, disposed on said body for generating a speed signal indicative of the speed of said body;

electronic means, disposed on said body, for generating an electrical engine noise simulation signal including:

a timing circuit, responsive to said speed signal and having a predetermined time constant, for developing a frequency control signal;

means, responsive to said frequency control signal, for generating a plurality of tone signals at respective frequencies in accordance with said frequency control signal;

combinatorial logic means, responsive to said tone signals and said control signal, for selectively generating said electrical engine noise simulation signal comprising a combination of respective tone signals in accordance with said control signal; and means responsive to said control signal, for selectively changing said predetermined time constant;

said toy further comprising transducer means disposed on said body for generating audible output signals indicative of electrical input signals applied thereto and means for applying said engine noise simulation signal to said transducer means as an electrical input signal.

17. The toy of claim 16 wherein said timing circuit comprises an RC network.

18. The toy of claim 16 wherein said means for generating a control signal comprises means for generating a signal indicative of respective states of increasing speed and decreasing speed of said body.

19. The toy of claim 17 wherein said means for generating a control signal comprises:

a differentiator responsive to said speed signal;

a Darlington amplifier responsive to said differentiator;

a Schmitt trigger circuit, responsive to output signals from said Darlington amplifier;

a resistance; and a unidirectional conductive device;

said resistance and unidirectional conductive device being serially coupled between said Schmitt trigger circuit and said resistance capacitance network, to effectively couple said resistance into said RC network during a selected operational state of said Schmitt trigger circuit.

20. The toy of claim 16 further including:

means, disposed within said body, for generating an electrical tire screeching simulation signal; and means for selectively applying said electrical tire screeching signal to said transducer means.

21. The toy of claim 20 wherein said means for selectively applying said electrical tire screeching signal to said transducer means includes means for inhibiting said means for applying said electrical engine noise simulation signal to said transducer during periods when said tire screeching signal is applied.

22. The toy of claim 20 further including:

means, disposed within said body for selectively generating an electrical crash simulation signal; and means for applying said electrical crash simulation signal as an input signal to said transducer means.

23. The toy of claim 22 wherein said means for applying said electrical crash simulation signal includes means for inhibiting said means for applying said engine noise simulation signal to said transducer means during periods when said crash signal is generated.

24. The toy of claim 22 wherein said means for generating an electrical crash simulation signal comprises:

means for generating an pseudo-random noise signal;

amplifier means, responsive to said noise signal and a bias signal applied thereto, for selectively generating said crash simulation signal; and means for varying said bias signal to said amplifier to effect a gradual amplitude decay of said crash simulation signal.

25. The toy of claim 22 wherein said means for generating an electrical crash signal comprises:

a shift register having plural stages, a data input terminal, and a clock input terminal, data at said data input terminal being loaded into the first stage of said shift register and the contents of each stage being shifted to the next successive stage in response to clock signals applied to said clock input terminal;

an oscillator for generating said clock signals;

an exclusive OR gate, having plural input terminals and an output terminal, said input terminals being receptive of signals indicative of the contents of respective stages of said shift register and said output terminal being connected to said shift register data terminal;

a counter, responsive to signals indicative of the contents of one of said shift register stages; and a flip-flop, having a data and clock input terminals and an output terminal, said flip-flop providing at its output terminal, responsive to signals applied to said clock input terminal, a signal indicative of the instantaneous signal applied at said data input terminal, said data input terminal having applied a signal indicative of the contents of one of said shift register stages and said clock terminal having applied output signals from said counter;

an amplifier, receptive of said flip-flop output signal and responsive to bias signals applied thereto; and means for selectively generating a varying bias signal to said amplifier to effect gradual amplitude decay of said crash simulation signal.

26. A toy vehicle comprising:

a body;

at least one wheel rotatably mounted to said body and disposed to cooperate with a ground surface such that said wheel rotates at a speed in accordance with the movement of said toy vehicle relative said ground surface;

generator means, mechanically cooperating with said wheel, for generating an electrical speed signal indicative of said speed of rotation;

electronic means, disposed within said body and responsive to said speed signal for generating an electrical engine noise simulation signal of frequency in accordance with said speed signal;

transducer means, disposed within said body, for producing an audio output indicative of input signals applied thereto; and means for selectively applying said electrical engine noise simulation signals to said transducer means as an input signal.

27. A toy of claim 26 wherein said generator means comprises:

a DC motor having a shaft; and means for mechanically coupling said motor shaft to said wheel such that said shaft is rotated at speeds in accordance with rotation of said wheel, whereby said motor is operative as a generator to produce said speed signal.

28. The toy of claim 27 wherein said electronic means includes:

governor means, responsive to said speed signal for generating a frequency control signal indicative of said speed signal with a controlled rate of change.

29. The toy of claim 28 wherein said governor means comprises a RC network.

30. The toy of claim 29 wherein said electronic means includes:

sensing means, responsive to said speed signal, for selectively changing the time constant of said RC network during states of acceleration or deceleration, respectively, of said wheel rotation.

31. The toy of claims 26 or 27 wherein said electronic means includes a voltage controlled oscillator (VCO) responsive to signals indicative of said speed signal, for generating a VCO output signal of a frequency indicative of the speed of rotation of said wheel; and multi-tone generator means, responsive to said VCO output signals, for generating an engine noise simulation signal having a plurality of frequency components at frequencies related to the frequency of said VCO output signal.

32. The toy of claims 28, 29 or 30 wherein said electronic means includes a voltage controlled oscillator (VCO) responsive to said frequency controlled signal, for generating a VCO output signal of a frequency indicative of the speed of rotation of said wheel; and multi-tone generator means, responsive to said VCO output signals, for generating an engine noise simulation signal having a plurality of frequency components at frequencies related to the frequency of said VCO output signal.

33. The toy of claims 31 or 32 wherein said multi-tone generator means comprises:

a plurality of frequency divider means for generating respective tone signals; and combinatorial logic means for selectively combining said tone signals.

34. The toy of claim 29 wherein said electronic means comprises:

a voltage controlled oscillator (VCO), responsive to said frequency control signal, for generating a VCO output signal;

a plurality of frequency divider means for generating respective tone signals at frequencies related to frequency of said VCO output signal; and combinatorial logic means, responsive to said tone signals and a control signal applied thereto for selectively combining said tone signals;

signals from said sensing means being applied as said control signal to said combinatorial logic to effect combination of different tones during respective states of acceleration and deceleration of said wheel rotation.

35. The toy of claim 3 wherein said switching means comprises means effecting application of said frequency divider output signal to said transducer means in response to turning movements of said vehicle.

36. The toy of claim 1 wherein said third means for selectively generating a tire screeching simulation signal includes:

means for generating a turn control signal indicative of turning movements by said body at speeds greater than a predetermined threshold speed, said turn control signal being applied to said means for selectively applying to effect application of said tire screeching simulation signals to said transducer means.

* * * * *